US007540238B2

(12) United States Patent
Zepic et al.

(10) Patent No.: US 7,540,238 B2
(45) Date of Patent: Jun. 2, 2009

(54) PROTECTIVE DEVICE FOR HOLDING A PRINTING STENCIL

(75) Inventors: Janez Zepic, Ljubljana (SI); Bostjan Podlipec, Vrhnika (SI)

(73) Assignee: LPKF Laser & Elektronika D.O.O., Zgornje Jezersko (SI)

( * ) Notice: Subject to any disclaimer, the term of this patent is extended or adjusted under 35 U.S.C. 154(b) by 486 days.

(21) Appl. No.: 11/152,706

(22) Filed: Jun. 14, 2005

(65) Prior Publication Data

US 2006/0021527 A1 Feb. 2, 2006

(30) Foreign Application Priority Data

Jun. 14, 2004 (DE) ..... 10 2004 028 448

(51) Int. Cl.
*B05C 17/08* (2006.01)
*B41F 15/36* (2006.01)

(52) U.S. Cl. ..... 101/127.1; 101/128.1

(58) Field of Classification Search ..... 101/127.1, 101/128.1; 38/102–102.9; 160/378–381
See application file for complete search history.

(56) References Cited

U.S. PATENT DOCUMENTS 3,482,343 A 12/1969 Hamu
5,076,162 A 12/1991 Goin ..... 101/127.1
5,113,611 A * 5/1992 Rosson ..... 38/102.7
5,271,171 A 12/1993 Smith
5,347,925 A * 9/1994 Holderegger ..... 101/127
6,038,969 A 3/2000 Podlipec et al. ..... 101/127.1
6,494,134 B2 12/2002 Erdmann ..... 101/127.1

FOREIGN PATENT DOCUMENTS

DE 39 34 929 4/1991
DE 197 49 449 C1 1/1999
GB 2388073 11/2003
GB 2388073 A * 11/2003

* cited by examiner

*Primary Examiner*—Leslie J Evanisko
(74) *Attorney, Agent, or Firm*—Darby & Darby

(57) ABSTRACT

A protective device with a frame includes protective bars for holding a printing stencil in a plane and joining means for fastening to a stencil stretcher frame, whereby the protective bars accommodate the edge of the printing stencil along its circumference in a manner that covers the edge. In addition, a stencil stretcher frame is provided for stretching a printing stencil held in a such protective device Adjacent protective bars, while forming the frame, are supported on each other with one of their respective end areas in a manner that allows a relative movement with respect to each other. For the stencil stretcher frame, a seat for accommodating the protective device and a joining means for fastening the protective device are provided.

11 Claims, 8 Drawing Sheets

PROTECTIVE DEVICE FOR HOLDING A PRINTING STENCIL

The invention relates to a protective device with a frame having protective bars for holding a printing stencil in a plane and with joining means for fastening to a stencil stretcher frame, whereby the protective bars accommodate the edge of the printing stencil along its circumference in a manner that covers said edge. Moreover, the invention relates to a stencil stretcher frame for stretching a printing stencil held in a protective device of the type mentioned above.

BACKGROUND

A protective device of the type mentioned above is known from U.S. Pat. No. 6,494,134 as a component of a foil stencil assembly. The foil stencil assembly comprises a foil stencil secured to a rigid frame in a planar configuration. The rigid frame has an upright side wall and a support flange extending inwardly from the upright side wall. The stencil foil rests on the support flange, and the outer edge of the foil stencil is positioned adjacent to the inner surface of said side wall. The stencil foil is secured along its circumference to the rigid frame. Due to the rigid frame, waviness of the foil stencil can hardly be avoided. The known foil stencil assembly can be mounted onto a stretcher frame so that a printing procedure can be carried out.

Moreover, German patent specification DE 197 49 449 C1 discloses a stencil stretcher frame for stretching stencils made of metal or plastic foils for stencil printing, said stencil stretcher frame having a stretching device for adjustable stretcher bars that can be operated by means of a pressure medium. The stretcher bars have gripping pins that engage with perforations of a stencil. The stretching device is made up of elastically deformable stretcher tubes that are arranged in a frame section, that can be uniformly charged with a pressure medium and on which the stretcher bars lie on the front. Moreover, the stretcher bars are provided at the rear with pivoting cams that rest on an end section of the frame section, namely, in such a way that the stretcher bars can be pivoted on the pivoting cams by means of the stretcher tubes in order to stretch the stencil. With this stencil stretcher frame, a stretching force can be applied uniformly onto the entire working surface of the stencil. In this manner, waviness of the stencil is avoided. In the known stencil stretcher frames, the stencil made of a metal or plastic foil has to be laid in place loosely by hand.

SUMMARY OF THE INVENTION

An object of the present invention is to provide a protective device that protects a printing stencil from damage and allows a flawless stretching of the printing stencil in a stencil stretcher frame. A further or alternate object of the present invention is to provide a stencil stretcher frame of the type mentioned above that allows precise printing with the printing stencil held in the protective device.

The present invention provides a protective device of the above-mentioned type in which adjacent protective bars, while forming the frame, are supported on each other with one of their respective end areas in a manner that allows a relative movement with respect to each other.

Therefore, the protective device according to the invention has a number of independent protective bars that are arranged flexibly with respect to each other. In this manner, distortions that occur in the printing stencil can be reliably avoided by holding said printing stencil in the protective device. The printing stencil is especially a metal or plastic foil or else thin, mechanically unstable sheet metal. Such printing stencils can preferably be used in so-called SMD printing machines (SMD stands for surface-mounted device). Precisely for such an application, it is highly advantageous that the protective device according to the invention allows printing with high precision and very low tolerances. In contrast to the rigid frame known from the state of the art, the protective device according to the invention makes it possible to reliably avoid waviness of the printing stencil, which would lead to an unsatisfactory printing result. Furthermore, the mechanical stress on the printing stencil is substantially reduced with the invention so that the service life of the stencil is prolonged quite considerably. Without external forces being exerted, tears in the printing stencil, for example, can be virtually ruled out since the printing stencil is held almost tension-free in the protective device. The frame of the protective device according to the invention is not held together, for example, due to a rigid construction of the frame, but rather, due to the traction exerted on the protective bars by the printing stencil held in the frame. Thus, potential waviness of the printing stencil is fundamentally compensated for autonomously just by the fact that the protective bars can move with respect to each other. The decisive factor here is the relative mobility of the protective bars in the plane of the frame and thus parallel to a plane of the printing stencil; this means that the plane of the frame and the plane of the printing stencil do not coincide or intersect anywhere in this space. Moreover, with the invention, the printing stencil can advantageously remain in the protective device over its entire service life; re-tightening and/or smoothing the stencil as is required with the prior-art rigid frames, can advantageously be dispensed with. In particular, due to the fact that the protective bars cover the edge of the printing stencil, a technician who is installing the printing stencil into or removing the printing stencil from a printing system, for example, is reliably protected from injuries, especially from being cut by a sharp edge of the printing stencil. As a result, the technician is at less risk from infections that can arise from wounds being contaminated with toxic materials that at times adhere to the printing stencil. The risk of the technician being injured by the printing stencil is ruled out with the invention. The fact that the edge of the printing stencil is accommodated in such a way as to be covered means that, in general, this edge is not completely exposed; for example, the protective bars can have an edge that projects into the plane of the printing stencil or beyond it. The edge of the printing stencil can be at a distance from such an edge of the protective bars in a planar direction of the printing stencil. Fundamentally, it is also conceivable, for example, for the edge of the protective bars to wrap around the edge of the printing stencil in a U-shaped manner. With the joining means, the protective device can be joined to the printing stencil in a simple manner for stretching the printing stencil in preparation for printing.

According to an advantageous embodiment of the invention, a guide element is provided between each one of the adjacent protective bars. Thus, in a simple manner, a controlled relative movement of the protective bars with respect to each other is prescribed, and this is determined by the guide element.

The construction of the protective device turns out to be especially simple and easy to manufacture if, according to an advantageous embodiment of the invention, the guide element is configured to be disk-shaped and if, in each case, it engages into a corresponding groove in the adjacent end areas of the adjacent protective bars. The guide element can be, for example, a metal platelet inserted into the grooves.

With a relatively simple construction, the guide element can allow the protective bars to make especially a linear relative movement, preferably in a plane parallel to the plane of the frame, if, according to an advantageous embodiment of the invention, the guide element has a biconvex shape and if the corresponding grooves have a concave groove bottom.

An especially simple and cost-effective guide element can be used for the protective device if, according to another advantageous embodiment of the invention, the guide element is configured as a bolt, each of which engages into a corresponding cutout in the adjacent end areas of the adjacent protective bars, and if the bolt is arranged in at least one of the cutouts with axial play and radial play relative to the axis of the bolt. The axial play and the radial play ensure the relative mobility of the protective bars with respect to each other and, due to this relative mobility according to the invention, the printing stencil can be arranged virtually force-free in the protective device; the protective device is not held together by the guide elements but rather by the printing stencil. Preferably, the cutout is oriented in the axial direction of the protective bar in a first of the adjacent protective bars, and perpendicular to the axial direction of the protective bar in the second of the adjacent protective bars.

In particular, the handling of the guide element during the assembly of the protective device can be simplified if, according to another advantageous embodiment of the invention, the guide element is configured as an elbow and it engages into a corresponding cutout in the adjacent end areas of the adjacent protective bars and if at least one leg of the elbow is arranged in the corresponding cutout with axial play and radial play relative to the axis of the elbow leg. The axial play and the radial play ensure the relative mobility of the protective bars with respect to each other and, due to this relative mobility according to the invention, the printing stencil can be arranged virtually force-free in the protective device; the protective device is not held together by the guide elements but rather by the printing stencil. Preferably, each cutout in the two adjacent protective bars is oriented in the axial direction of the protective bar. These cutouts are preferably blind holes.

Fundamentally, the frame can have any shape, for example, it can be constructed as a triangle with three protective bars or as an octagon with eight protective bars. In order to achieve tension-free, unhindered holding of the printing stencil, however, it is especially advantageous if, according to an embodiment of the invention, the frame has four protective bars that form a rectangle; preferably, the four protective bars can form a square frame.

According to another advantageous embodiment of the invention, the protective bars each have at least one retaining bolt that extends perpendicularly to the plane of the frame in order to pass through a corresponding cutout in the printing stencil. In this manner, a precise and especially simple arrangement of the printing stencil on the protective bars is ensured.

The printing stencil can easily be affixed in that, according to an advantageous embodiment of the invention, the retaining bolts comprise a plastically deformable material such as, for example, plastic or aluminum. For instance, after the retaining bolt has passed through a cutout in the printing stencil, the material can be deformed in such a manner that the printing stencil can no longer be removed from the protective bars without damage and the printing stencil is permanently and securely held in the frame. Since the invention allows the printing stencil to remain in the protective device over its entire service life, which is a function of the printing results that are to be achieved with it, a separation of the printing stencil from the protective bars is fundamentally not necessary at any point in time.

According to another advantageous embodiment of the invention, the retaining bolts have a radial channel structure at their end that passes through the printing stencil. Such a channel structure, which can also be thread-shaped, allows, for example, spring washers that hold the printing stencil down against the protective bars to be screwed on or slipped on so as to latch onto the retaining bolts.

If, according to another advantageous embodiment of the invention, the retaining bolts have an axial cutout at their end that passes through the printing stencil, then this can be used in a simple manner, for example, for screwing a hold-down pad for the printing stencil into the retaining bolts or for placing a tool for the targeted plastic deformation of the retaining bolts.

A very precise arrangement of the printing stencil in the protective device can be achieved if, according to another advantageous embodiment of the invention, the protective bars each have at least one positioning pin extending perpendicular to the plane of the frame so as to pass through a corresponding positioning cutout in the printing stencil. The slight play of the positioning pin in the positioning cutout, which is necessary for production and assembly reasons, is preferably less than the play that is allowed by guide the elements between adjacent protective bars of the protective device. In addition to ensuring a precise positioning of the printing stencil, the positioning pin can advantageously also serve for matching purposes, so that, for example, it can be used to ensure that the printing stencil can only be placed in the correct side alignment in the protective device and/or it can be used to ensure that that only printing stencils of a certain type can be arranged in the protective device.

According to another advantageous embodiment of the invention, the cross section of at least one of the protective bars is U-shaped and the edge of the printing stencil can be accommodated between the legs of the U; preferably, all of the protective bars are U-shaped in this manner, so that advantageously, especially thinner printing stencils, for example, those having a thickness of less than 0.1 mm, can be securely accommodated. In this manner, the printing stencil can be held in the protective device very securely and especially well-protected against damage. The U-shaped configuration in the protective bar can preferably be created by a groove in the protective bar or by a contact wall on the protective bar, said contact wall corresponding to a wall of the protective bar opposite from the contact wall.

The invention also provides a stencil stretcher frame of the type described above, in which a seat for accommodating the protective device and a joining means for fastening the protective device are provided.

With the seat according to the invention that accommodates the protective device, it is advantageously ensured that the protective device that holds the printing stencil is unmistakably and accurately matched to the stencil stretcher frame. Thus, a high printing precision is assured. Moreover, the joining means ensures that the protective device can remain securely and permanently matched to the stencil stretcher frame in a predefined position while maintaining precise geometries, namely, without any deterioration of the printing result. In order to be able to use the stencil stretcher frame to ensure a precise, waviness-free and flawless stretching of the printing stencil—which is an indispensable requirement for high printing accuracy—it is important for the protective device with the printing stencil to be completely positioned in the seat before the stretching by means of the stencil stretcher frame. The actual stretching of the printing stencil can be carried out advantageously, for example, in the same manner as with the prior art stencil stretcher frame described above.

According to an advantageous embodiment of the invention, in a very simple manner, a very precise and accurate matching of the stencil stretcher frame and the protective device can be achieved in that the seat has a stop positioned perpendicular to the plane of the frame of the protective device and a stop positioned parallel to the plane of the frame of the protective device.

In view of the great importance of the positioning of the protective device on the stencil stretcher frame for a neat, exact printing result, another especially advantageous embodiment of the invention is one in which the seat has a visual marking to indicate whether the protective device has been completely accommodated. Thus, a technician can directly and reliably check the correctness of the positioning of the protective device.

According to another advantageous embodiment of the invention, the joining means has a cutout for engaging and latching a joining pin of the protective device. The latching effectuated by means of the joining pin and the cutout allows a cost-effective, easily released connection of the protective device and the stencil stretcher frame.

The latching entails only minimal production requirements, coupled with low material costs and high durability, if, according to another embodiment of the invention, the cutout has an O-ring that can engage in a circumferential groove of the joining pin.

According to another advantageous embodiment of the invention, an especially easy-to-operate joining means can be created in that the joining means has a sliding element that, in a first sliding position, releases the protective device and, in a second sliding position, positively joins the protective device to the stencil stretcher frame.

BRIEF DESCRIPTION OF THE DRAWINGS

The invention allows numerous embodiments. In order to further illustrate their basic principle, a number of them are schematically depicted in the drawing and described below. The following is shown in the drawing.

DETAILED DESCRIPTION

Figure 1:
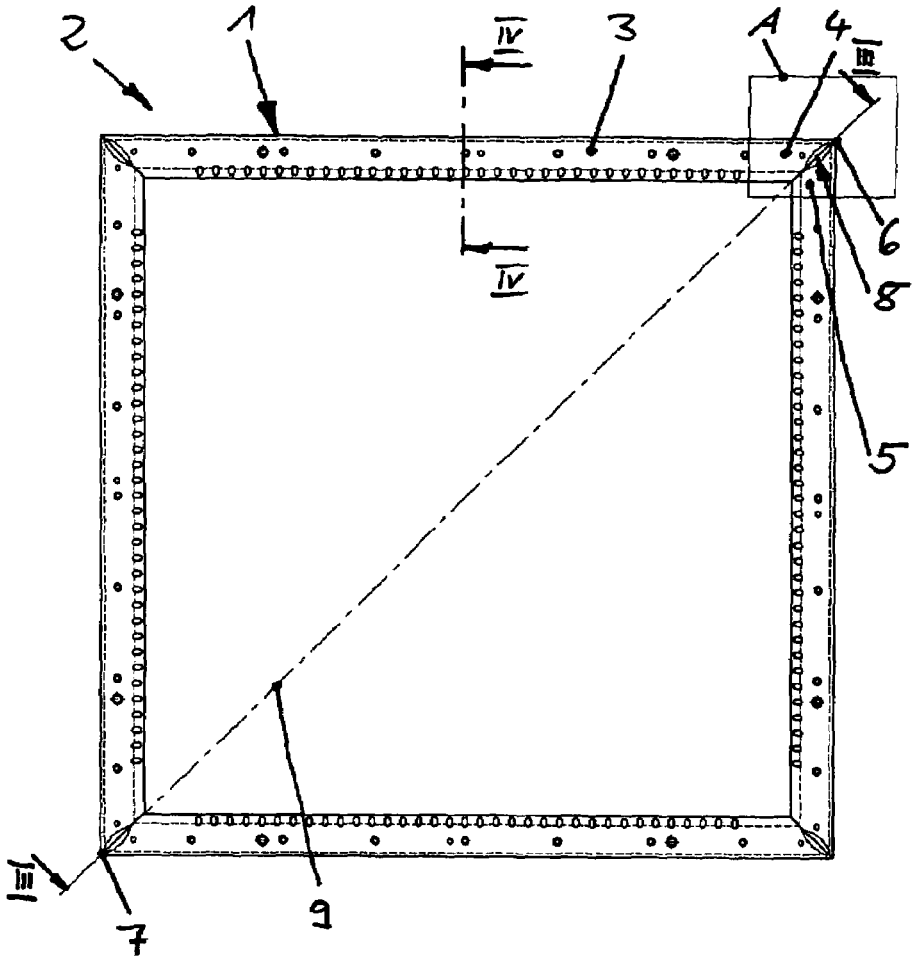
FIG. 1 a top view of a protective device configured as a frame for a printing stencil, FIG. 2 an enlarged detail of the protective device according to FIG. 1, FIG. 3 a section of the detail according to FIG. 2 taken across line III-III in FIG. 1, FIG. 4 a partial section of the frame according to FIG. 1, with a printing stencil held by a first retaining bolt, FIG. 5 a partial section of the frame according to FIG. 1, with a printing stencil held by a second retaining bolt, FIG. 6 a top view of a corner area of a printing stencil, FIG. 7 a partial section of a stencil stretcher frame with a protective device, with a printing stencil and with a joining means, FIG. 8 a side view of a holding bar of a quick-acting closure, FIG. 9 a top view of the holding bar according to FIG. 8, FIG. 10 a top view of a corner area of a protective device with holding hooks, FIG. 11 a side view of the protective device according to FIG. 10, FIG. 12 a partial section of a stencil stretcher frame with a protective device and with an alternative joining means, FIG. 13 a partial section of the frame according to FIG. 1 with a printing stencil held by a third retaining bolt, FIG. 14 a protective device with a pre-positioning means for a printing stencil, in a view from below, FIG. 15 a partial section of the protective device according to FIG. 14, FIG. 16 a corner area of a protective device with a guide element in bolt form, FIG. 17 a corner area of another protective device with an elbow-shaped guide element, FIG. 18 a top view of a section of a protective bar, FIG. 19 a section of the protective bar according to FIG. 18, FIG. 20 a top view of a section of another protective bar and FIG. 21 a section of the protective bar according to FIG. 20.

Corresponding elements in the embodiments are designated with the same reference numerals in all of the figures.

FIG. 1 shows a top view of a protective device 2 configured as a square frame 1 for holding a printing stencil (not shown here) in a plane. The frame 1 has four protective bars 3, whereby adjacent protective bars 3 are supported on each other with one of their end areas 4, 5. Here, a relative movement between the adjacent protective bars 3 is possible; in this particular embodiment, a relative movement is possible in the plane of the frame 1 and along the line 9 that joins opposite corners 6, 7 of the frame 1 and that intersects a contact area 8 of the protective bars 3. The protective bars 3 are preferably made of aluminum sections or plastic sections.

Figure 2:
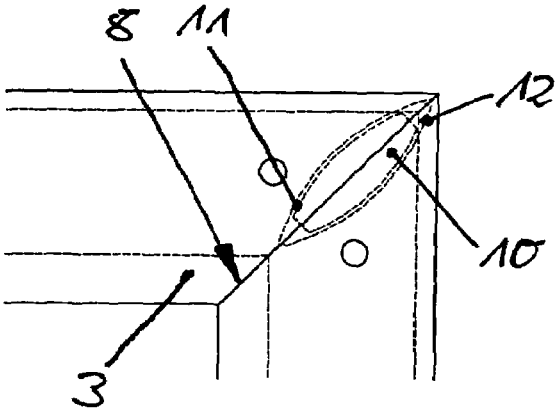

A detail characterized by a frame A in FIG. 1 and comprising a contact area 8 of the protective bars 3 is shown in enlarged form in FIG. 2. It can be seen that, between the adjacent protective bars 3, there is a disk-shaped guide element 10—in this case it is biconvex. The guide element 10 is a metal platelet that is slid into a groove 11 (shown by a dashed line) in the end areas 4, 5 of adjacent protective bars 3. The grooves 11 are arranged in a plane that is parallel to the plane of the frame 1 and they have a concave groove bottom 12 corresponding to the biconvex shape of the guide element 10.

Figure 3:
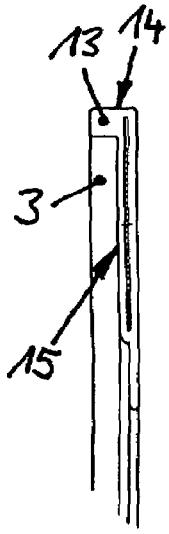

FIG. 3 shows a section taken across line III-III in FIG. 1 of the detail described above. It can be seen that the protective bars 3 have a projecting edge 13 on their outside 14. Facing inwards, that is to say, towards the middle of the frame, the protective bars 3 are provided with a contact surface 15 for the printing stencil. The contact surface 15 is provided continuously on the inside of the entire frame 1 (FIG. 1) in order to support the printing stencil. FIG. 3 shows the inserted guide element 10, likewise in a sectional view.

Figure 4:
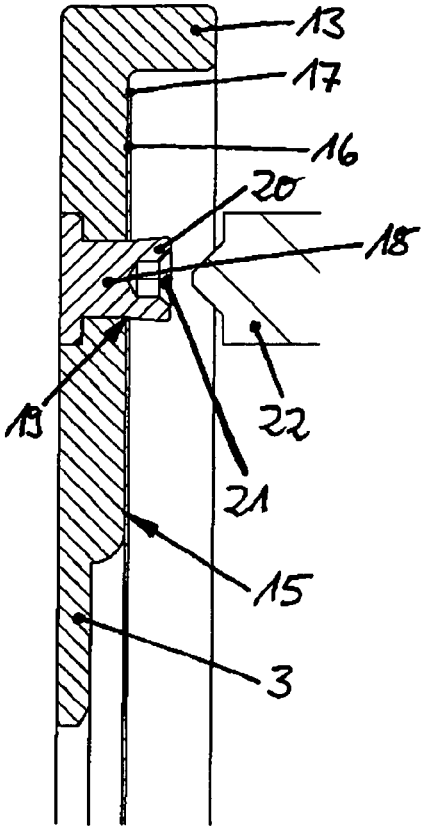

FIG. 4 shows a section taken across line IV-IV in FIG. 1, but including a printing stencil 16. The printing stencil 16 lies on the inner contact surface 15 of the protective bar 3 and is supported by said protective bar 3. The edge 13 of the protective bar 3 covers the outer edge 17 of the printing stencil 16 and thus, on the one hand, protects the printing stencil 16 (for example, from tearing) and, on the other hand, also a technician who is handling the printing stencil 16 (for example, from injuries such as cuts that could be caused by a sharp edge 17 of the printing stencil 16).

The printing stencil 16 is held by a retaining bolt 18 that is inserted into the protective bar 3 and that extends perpendicular to the plane of a frame having the protective bar 3, said retaining bolt 18 passing through a cutout 19 in the printing stencil 16. The retaining bolt 18 has a central axial cutout 21 on its end 20 that passes through the printing stencil 16, said cutout corresponding to a deformation tool 22. The retaining bolt 18 comprises a plastically deformable material, for example, a plastic or aluminum, so that a blow with the deformation tool 22 on the end 20 of the retaining bolt 18 that passes through the printing stencil 16 leads to its permanent deformation, which results in an enlargement of its outer circumference. In this manner, the printing stencil 16 is securely held on the contact surface 15 of the protective bar 3. The described situation applies to all of the protective bars 3 of the frame 1.

Figure 5:
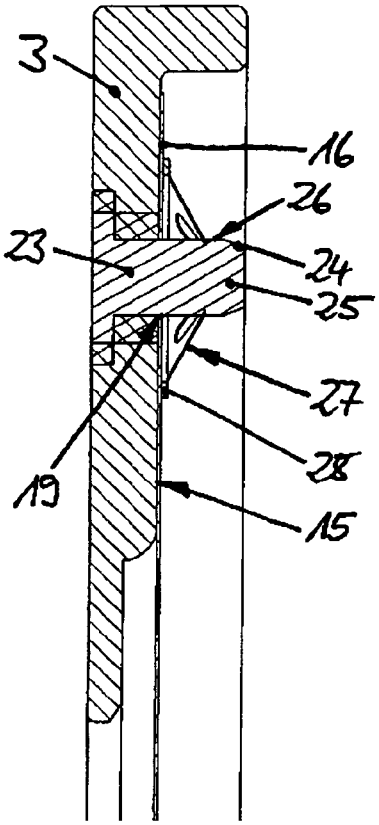

An alternative solution with a different retaining bolt 23 is shown in FIG. 5 in a view corresponding to that of FIG. 4. The retaining bolt 23 extends perpendicular to the plane of a frame having the protective bar 3 and passes through the printing stencil 16 in a corresponding cutout 19. At its end 25 that passes through the printing stencil 16 and that is provided with a bevel 24, the retaining bolt 23 has a radial channel structure 26, especially an outer thread. A conical spring washer 27 is pushed or screwed onto the channel structure 26 and it reliably holds the printing stencil 16 on the contact surface 15 of the protective bar 3. In order to protect the printing stencil 16, a washer 28 is positioned between the spring washer 27 and the printing stencil 16.

Figure 6:
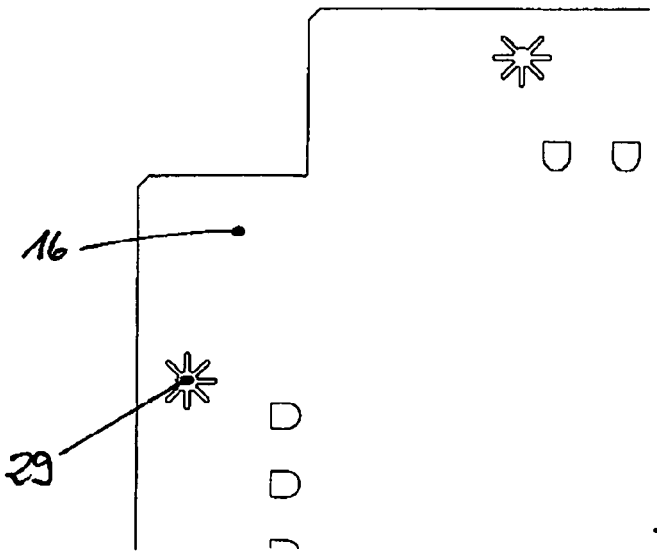

FIG. 6 shows a corner area of a printing stencil 16 with cutouts 29 that are star-shaped. Such cutouts 29, pushed onto retaining bolts 23 according to FIG. 5, make it possible to dispense with the spring washer 27 shown in the embodiment according to FIG. 5. With the star-shaped cutouts 29 and corresponding retaining bolts, in contrast, the printing stencil is automatically held on the frame of a protective device.

Figure 7:
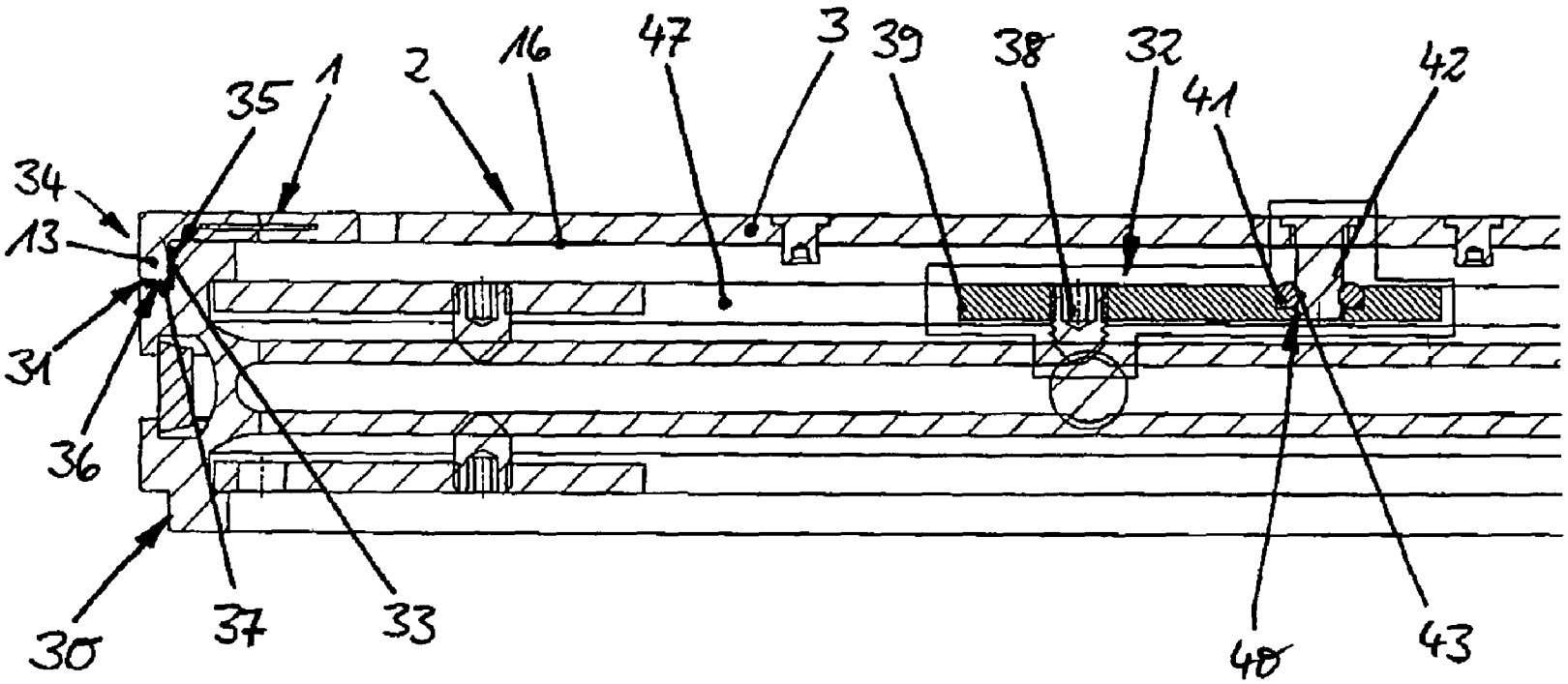

A section of a stencil stretcher frame 30 for stretching a printing stencil 16 held in a protective device 2 is shown as a partial cross section in FIG. 7. The stencil stretcher frame 30 has a seat 31 for accommodating the protective device 2 as well as a joining means 32 for fastening the protective device 2 to the stencil stretcher frame 30. The seat 31 is formed by a step 33 that encircles the stencil stretcher frame 30. The step 33 corresponds to a projecting shoulder 34 of the protective device 2, said shoulder being formed by the projecting edges 13 of protective bars 3 as well as by contact surfaces 15 for the printing stencil 16 that are provided on the protective bars 3 and that are arranged at an angle of 90° C. with respect to the edges 13. The shoulder 34 encircles a flat frame 1 of the protective device 2 having the protective bars 3.

The seat 31 has a first stop 35 perpendicular to the plane of the frame 1 of the protective device 2 as well as a second stop 36 parallel to the plane of the frame 1 of the protective device 2, so that the protective device 2 is positioned precisely with respect to the stencil stretcher frame 30. In order to be able to easily check the positioning of the protective device 2, the seat 31 has a visual marking 37 that, in this embodiment, is applied onto the step 33 as a layer of paint in a conspicuous color, for example, bright red.

The joining means 32 has a quick-acting closure with a holding bar 39 that is fastened to the stencil stretcher frame 30 by means of a screw 38, for example, a hexagon socket-head bolt, and that is provided with a cutout 40 in which an O-ring 41 is arranged. A joining pin 42 with a circumferential groove 43 arranged on the protective device 2 engages into the cutout 40. The circumferential groove 43 accommodates the O-ring 41 and thus brings about a fastening of the protective device 2 onto the stencil stretcher frame 30. The holding bar 39 is fastened in a groove 47 of the stencil stretcher frame 30. In order to manually unlock the protective device 2 and the stencil stretcher frame 30, one must reach into the groove 47 and lift the protective device 2.

Figure 8:
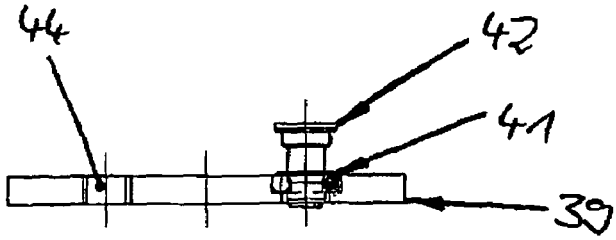
Figure 9:
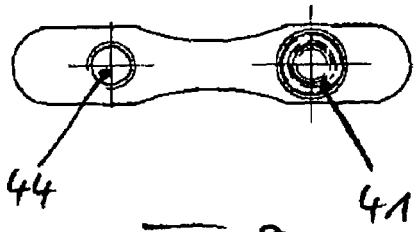

For purposes of illustration, the holding bar 39 according to FIG. 7 is shown separately in FIGS. 8 and 9 in a side view and in a top view, with the appertaining joining pin 42 and with the O-ring 41 that cooperates with the joining pin 42 to effectuate the latching. A cutout 44 serves to accommodate the screw 38 (FIG. 7) for fastening to the stencil stretcher frame.

Figure 10:
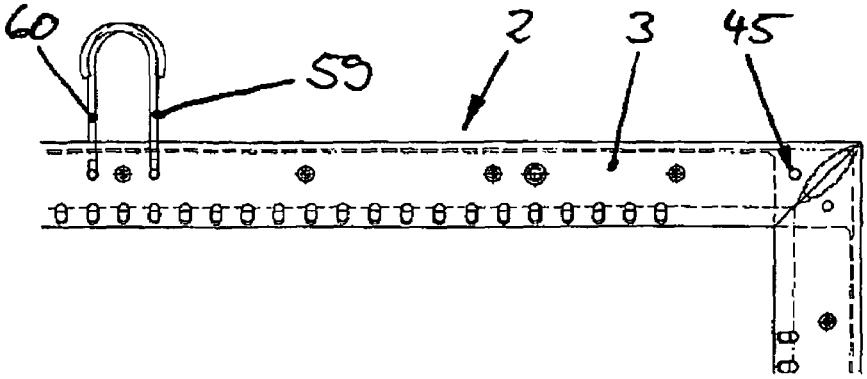
Figure 11:
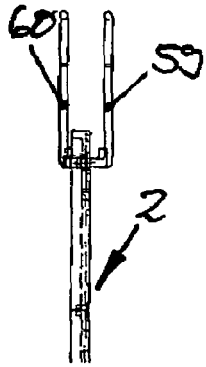

FIG. 10 (top view) and FIG. 11 (side view) show a corner area of a protective device 2 having protective bars 3 and having openings 45 in the protective bars. The openings that do not coincide with the printing stencil are provided to accommodate holding hooks 59, 60 on which the protective device 2 can be hung up in a storage place when the printing stencil held in said protective device is not in use. Moreover, when the printing stencil is washed and dried, it can advantageously be handled by the holding hooks 59, 60.

Figure 12:
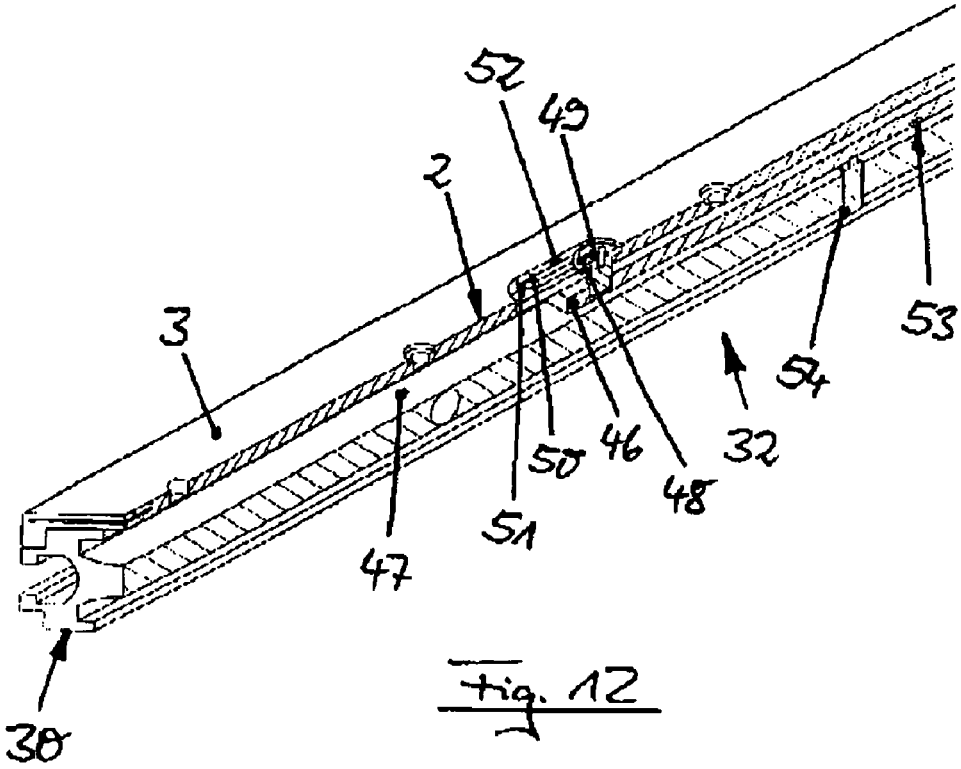

FIG. 12 shows a section of a stencil stretcher frame 30 with a protective bar 3 of a protective device 2 and with a joining means 32 for joining the stencil stretcher frame 30 and the protective device 2. The joining means 32 has a sliding element 46 that runs in a groove 47 of the stencil stretcher frame 30. The sliding element 46 is firmly joined to a screw 49 having a radially projecting head 48, whereby the head 48 can be guided on a groove shoulder 50 of a groove 52 in the protective bar 3. At a first end of the groove 52 in the protective bar 3, the groove shoulder 50 has an enlargement 51 through which the head 48 of the screw 49 can be passed, whereas the groove shoulder 50 at the second end of the groove 52 grips below the head 48 of the screw 49. In the position shown in FIG. 12, the sliding element 46 is in a second sliding position that positively joins the protective device 2 to the stencil stretcher frame 30. In a first sliding position (not shown here), the protective device can be removed from the stencil stretcher frame 30 in that the enlargement 51 of the groove shoulder 50 of the groove 52 in the protective bar 3 releases the head 48 of the screw 49 located on the sliding element 46. The sliding element 46 is also provided with two cutouts 53 into which a bolt 54, which is arranged on the stencil stretcher frame 30 so as to be spring-loaded, can engage. The bolt 54 secures the sliding element 46 in the first as well as in the second sliding position.

Such a joining means 32, shown in FIG. 12, can generally also serve to fasten protective bars 3 without a printing stencil onto a stencil stretcher frame as is known, for instance, from German patent specification DE 197 49 449 C1, in order to cover edge areas of a printing stencil arranged on the stencil stretcher frame and/or for tightening the gripping pins of the stencil stretcher frame that are provided for the printing stencil. Hence, the protective bars 3 can be used in multifaceted ways.

Figure 13:
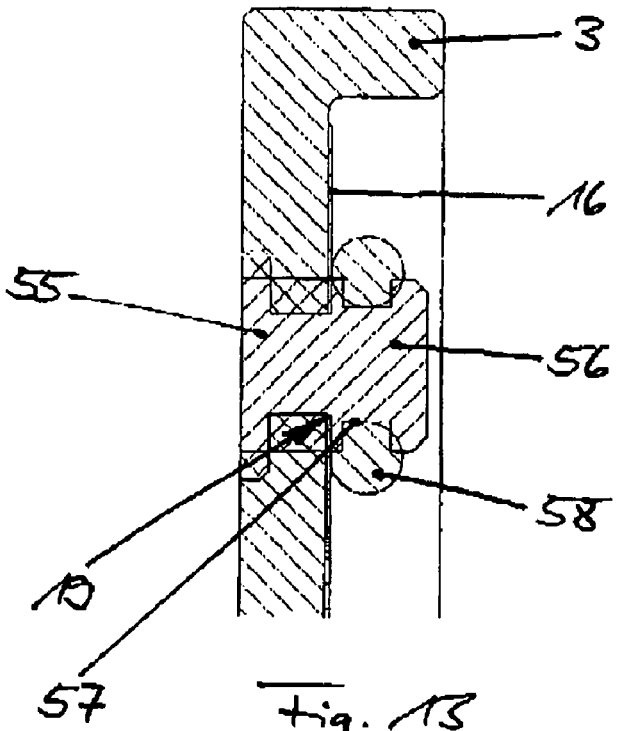

FIG. 13 shows another possibility for holding a printing stencil 16 on a protective bar 3 in a view corresponding to that of FIGS. 4 and 5. A retaining bolt 55 extends perpendicularly to the plane of a frame having the protective bar 3 and passes through the printing stencil 16 in a corresponding cutout 19. At the end 56 of the retaining bolt 55 that passes through the printing stencil 16, there is a circumferential groove 57 with an O-ring 58. The O-ring 58 holds the printing stencil 16 onto the protective bar 3.

Figure 14:
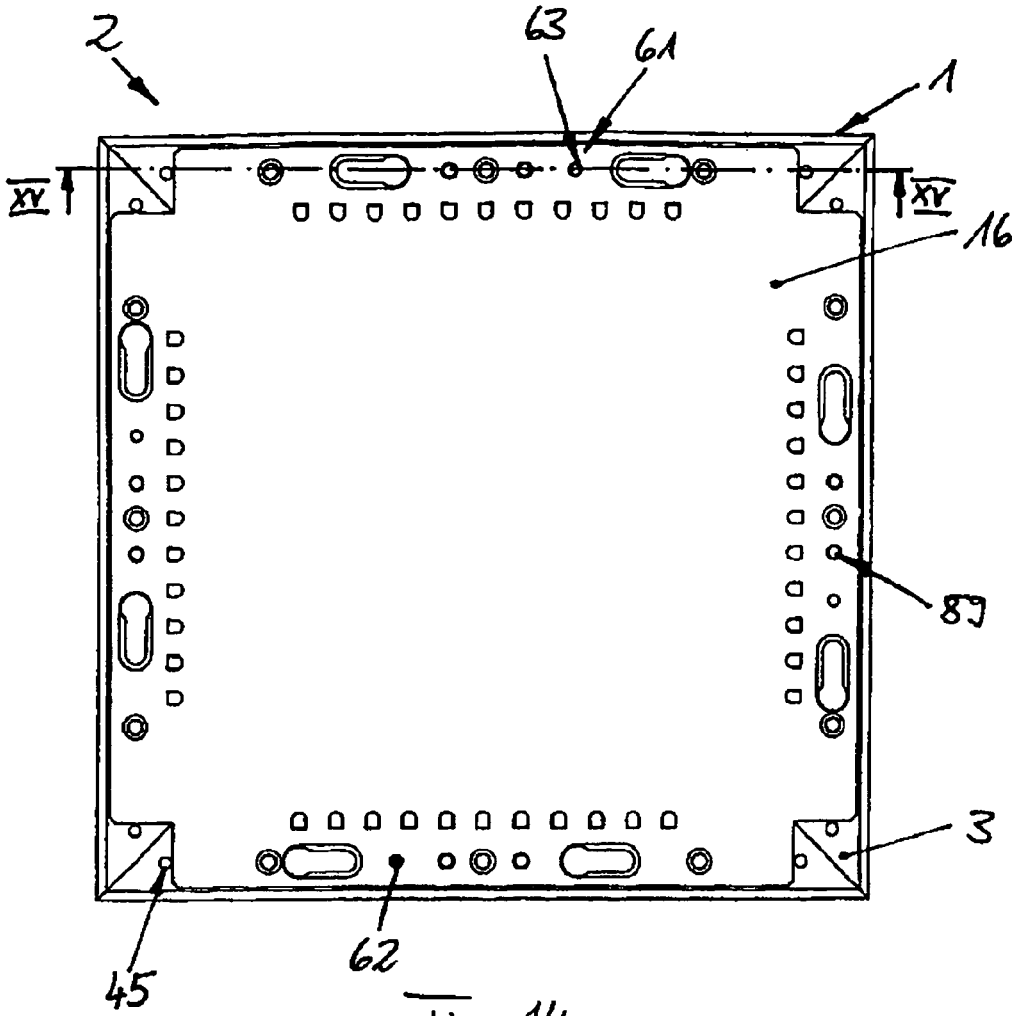

FIG. 14 shows a protective device 2 with a pre-positioning means 61 for a printing stencil 16 in a view from below. The protective device 2 is configured as a square frame 1 and has four protective bars 3. The protective bars 3 each have a positioning pin 62 extending perpendicularly to the plane of the frame in order to pass through a positioning cutout 63 in the printing stencil 16 corresponding to the appertaining positioning pin 62. Openings 45 in corner areas of the protective bars 3 and openings 89 arranged approximately in the middle in the lengthwise direction of the protective bars 3 serve to hang up the protective device 2 with the printing stencil 16.

Figure 15:
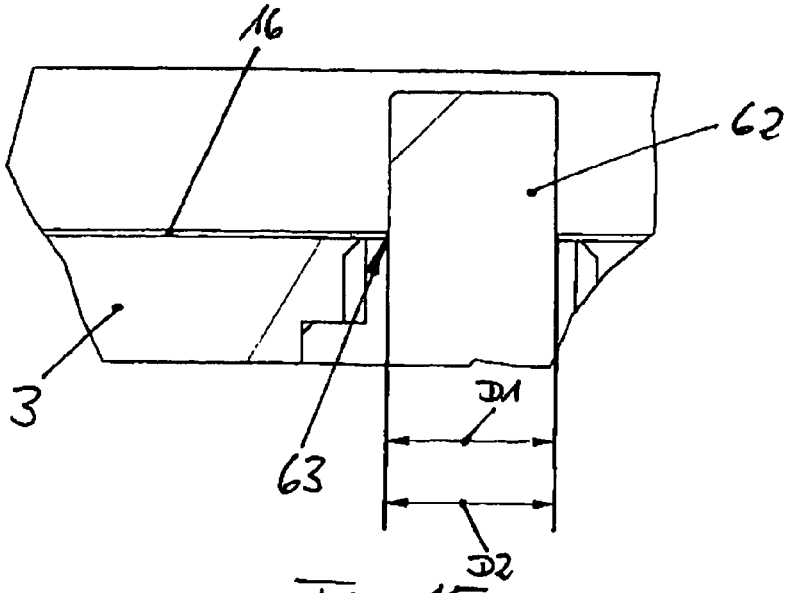

FIG. 15 shows a partial section taken across line XV-XV of the protective device of FIG. 14. It can be seen that the positioning pin 62 having a diameter D1, for example, of 3.95 mm, passes through the positioning cutout 63 having a diameter D2, for example, 4.00 mm, in the printing stencil 16. The positioning pin is inserted into the protective bar 3.

Figure 16:
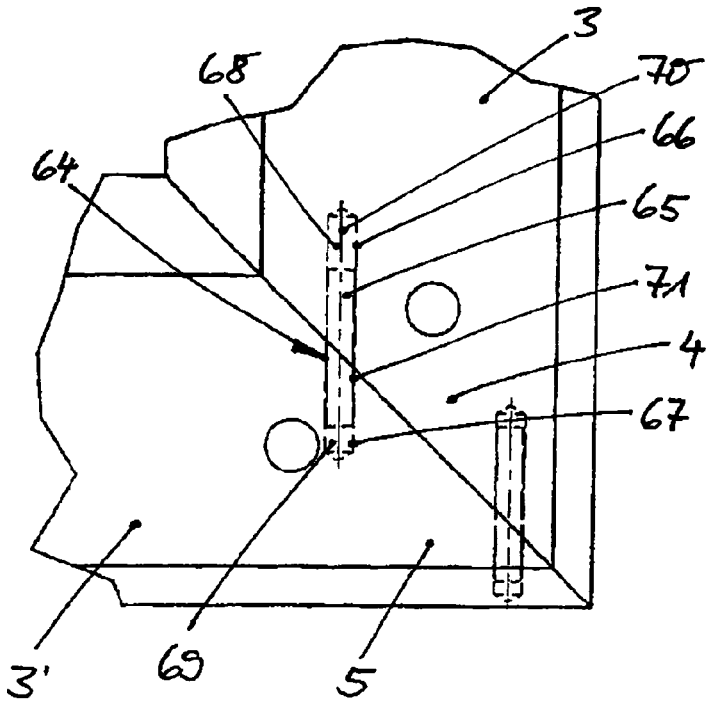

FIG. 16 shows a corner area with two adjacent protective bars 3, 3' that are supported on each other with one of their respective end areas 4, 5 in a manner that allows a relative movement with respect to each other. A guide element 64 configured as a bolt 65 is arranged between the adjacent protective bars 3, 3', whereby it can be seen that, in this embodiment, a total of exactly two such guide elements 64 are provided between the adjacent protective bars 3. The bolts 65 each engage, on the one hand, into a cutout 66 that is configured as a blind hole and that is oriented in the axial direction of a first protective bar 3 of the adjacent protective bars 3, 3' and, on the other hand, into a cutout 67 that is configured as a blind hole and that is oriented perpendicular to the axial direction of a second protective bar 3' of the adjacent protective bars 3, 3'. In each case, axial play 68, 69 of the bolt 65 in the cutouts 66, 67 relative to the bolt axis 70, can be clearly seen. In addition, there is radial play 71 of the bolt 65 in the cutouts 66, 67 relative to the bolt axis 70, said radial play 71 being smaller than the axial play 68, 69. The axial play 68, 69 and the radial play 71 permit a relative mobility of the protective bars 3, 3'.

Figure 17:
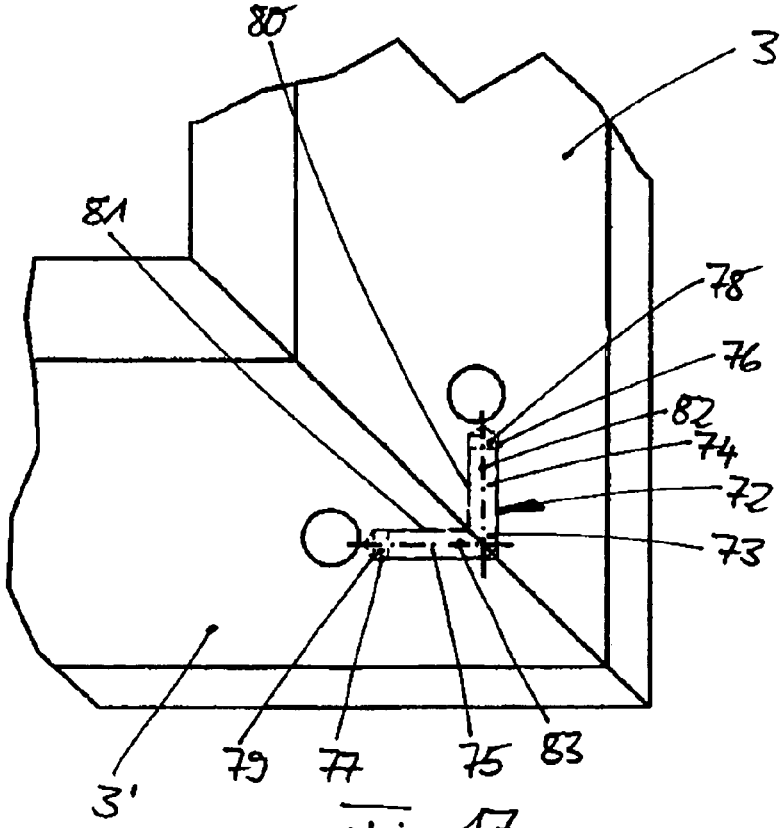

FIG. 17 shows a similar corner area of a protective device, but with a different guide element 72. This guide element 72 is configured as an elbow 73 and it engages with one elbow leg 74, 75 into corresponding cutouts 76, 77 of adjacent protective bars 3, 3' that are supported on each other. In order to ensure the relative mobility of the protective bars 3, 3' in each of the corresponding cutouts 76, 77—relative to the appertaining axes 82, 83 of the elbow legs 74, 75—each of the elbow legs 74, 75 is arranged with axial play 78, 79 and with radial play 80, 81.

Figure 18:
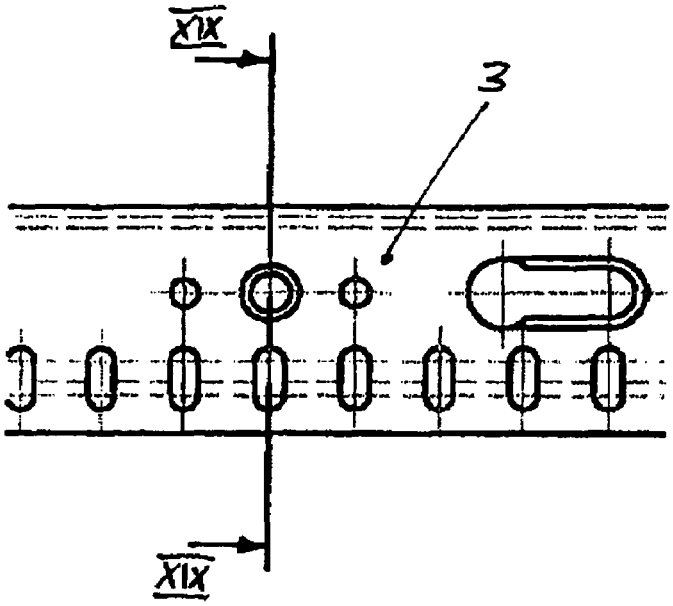
Figure 19:
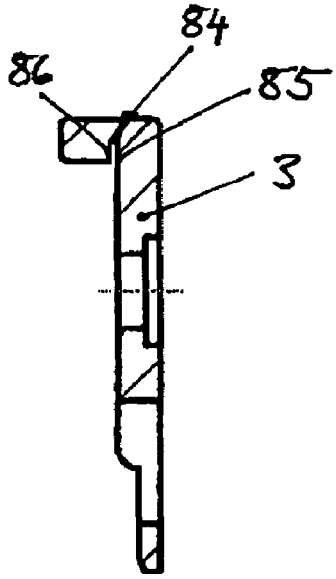

FIG. 18 shows a top view of a section of a protective bar 3 and FIG. 19 shows an enlarged section of said protective bar 3 taken across line XIX-XIX. The protective bar 3 has a U-shaped cross section, whereby the U-shaped configuration is formed in the protective bar 3 by a groove 84 that lies in the plane in which the printing stencil is to be arranged. A printing stencil can be accommodated between the legs 85, 86 of the U formed in this manner.

Figure 20:
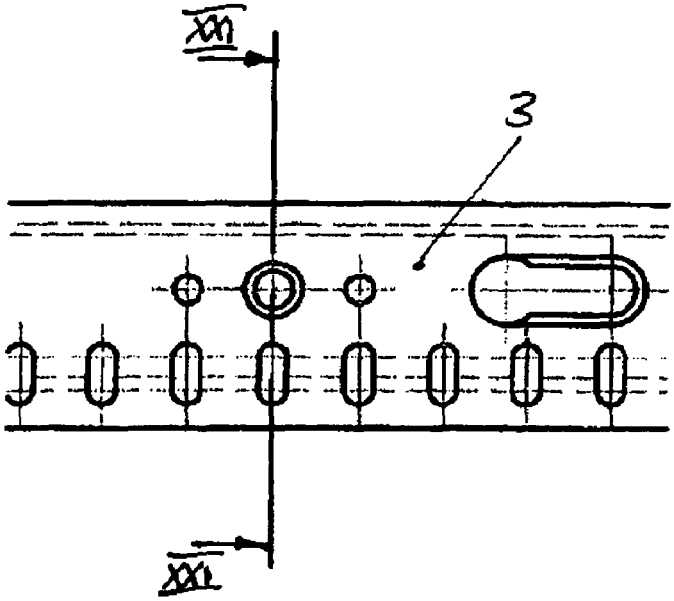
Figure 21:
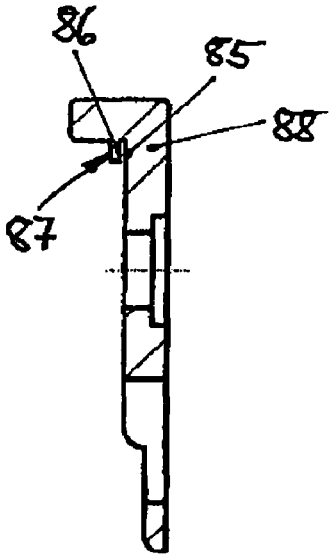

FIG. 20 shows a top view of a section of a similar protective bar 3 and FIG. 21 shows an enlarged view of said protective bar 3 taken across line XXI-XXI. The protective bar 3 of this embodiment is likewise configured with a U-shaped cross section. Here, the U-shaped cross section is formed by a contact wall 87 on the protective bar 3, said contact wall 87 corresponding to a wall 88 of the protective bar opposite from the contact wall 87, thereby forming legs 85, 86 of the U, between which a printing stencil can be accommodated.

What is claimed is:

1. A protective device for a printing stencil having a circumferential edge comprising:

a protective frame formed by a plurality of protective bars configured to hold the printing stencil in a plane and to accommodate the circumferential edge along a circumference of the printing stencil so as to cover the circumferential edge, wherein adjacent ones of the plurality of protective bars are supported on each other at respective end areas so as to allow movement relative to each other along a line joining opposite corners of the frame; and a joining device configured to fasten the frame to a stencil stretcher frame.

2. The protective device as recited in claim 1, further comprising a guide element disposed between each of the adjacent protective bars.

3. The protective device as recited in claim 2, wherein the guide element is disk-shaped and engages into a corresponding groove in the adjacent end areas of each of the adjacent protective bars.

4. The protective device as recited in claim 3, wherein the guide element has a biconvex shape and each of the corresponding grooves have a concave groove bottom.

5. The protective device as recited in claim 1, wherein the frame includes four protective bars that form a rectangle.

6. The protective device as recited in claim 1, wherein the protective bars each have at least one retaining bolt that extends perpendicularly to the plane so as to pass through a corresponding stencil cutout in the printing stencil.

7. The protective device as recited in claim 6, wherein each of the retaining bolts includes a plastically deformable material.

8. The protective device as recited in claim 6, wherein each of the retaining bolts has a radial channel structure at an end area of the retaining bolt that passes through the printing stencil.

9. The protective device as recited in claim 6, wherein each of the retaining bolts has an axial cutout at an end area of the retaining bolt that passes through the printing stencil.

10. The protective device as recited in claim 1, wherein each of the protective bars has at least one positioning pin extending perpendicular to the plane so as to pass through a corresponding positioning cutout in the printing stencil.

11. The protective device as recited in claim 1, wherein a cross section of at least one of the protective bars is U-shaped and a corresponding portion of the circumferential edge of the printing stencil is accommodated between legs of the U-shaped protective bar.

* * * * *